US007584769B2

(12) United States Patent
D'Incau et al.

(10) Patent No.: US 7,584,769 B2
(45) Date of Patent: Sep. 8, 2009

(54) METHOD AND APPARATUS FOR THE INSERTION OF A WEFT THREAD

(75) Inventors: Remo D'Incau, Winterthur (CH); Marius Bachofen, Benken (CH); Davide Maccabruni, Thalwil (CH)

(73) Assignee: Sultex AG, Rueti (CH)

( * ) Notice: Subject to any disclaimer, the term of this patent is extended or adjusted under 35 U.S.C. 154(b) by 0 days.

(21) Appl. No.: 11/978,853

(22) Filed: Oct. 29, 2007

(65) Prior Publication Data

US 2008/0105326 A1 May 8, 2008

(30) Foreign Application Priority Data

Nov. 2, 2006 (EP) ..... 06123401
Jul. 19, 2007 (EP) ..... 07112777

(51) Int. Cl.
*D03D 47/18* (2006.01)
*D03D 47/20* (2006.01)
*D03D 47/23* (2006.01)
*D03D 49/50* (2006.01)

(52) U.S. Cl. ..... 139/448; 139/116.1; 139/439; 139/450; 139/216

(58) Field of Classification Search ..... None
See application file for complete search history.

(56) References Cited

U.S. PATENT DOCUMENTS 3,411,548 A * 11/1968 Pfarrwaller ..... 139/452
3,532,136 A * 10/1970 Golobart ..... 139/448
3,902,535 A * 9/1975 Jusko et al. ..... 139/134
4,228,828 A * 10/1980 Loepfe et al. ..... 139/370.2
4,428,405 A * 1/1984 Schumperli ..... 139/341
4,520,851 A * 6/1985 Rohr et al. ..... 139/448
4,587,998 A * 5/1986 Egloff et al. ..... 139/448
5,007,463 A * 4/1991 Corain et al. ..... 139/448
5,179,980 A * 1/1993 Hubner et al. ..... 139/450
5,323,324 A * 6/1994 Fredriksson ..... 700/130
5,398,731 A * 3/1995 Schuster ..... 139/194
5,398,732 A * 3/1995 Zenoni et al. ..... 139/450
5,862,837 A * 1/1999 Guenther et al. ..... 139/448
6,092,561 A * 7/2000 Schmid ..... 139/196.2
6,095,449 A * 8/2000 Gallo et al. ..... 242/365.4
6,179,014 B1 * 1/2001 Shaw ..... 139/448

(Continued)

FOREIGN PATENT DOCUMENTS

EP 0 690 160 A1 1/1996

(Continued)

*Primary Examiner*—Bobby H Muromoto, Jr.
(74) *Attorney, Agent, or Firm*—Townsend and Townesnd and Crew, LLP

(57) ABSTRACT

A method for the insertion of a weft thread into a shed of a rapier weaving machine is presented in which the weft thread (3) is taken up by a bringer rapier (10) and fixedly clamped in the same by means of a thread clamp, is inserted into the shed by means of the bringer rapier and is taken up by a taker rapier. In the said method the clamping force of the thread clamp in the bringer rapier is additionally controlled during the weft insertion in such a way that the clamping force (F0) during the take-up of the weft thread and/or during the transfer of the weft thread is reduced relative to the clamping force (F1) in the insertion phase lying therebetween.

19 Claims, 4 Drawing Sheets

U.S. PATENT DOCUMENTS

| | | | | |
|---|---|---|---|---|
| 6,227,259 | B1 * | 5/2001 | Verclyte | 139/448 |
| 6,305,434 | B1 * | 10/2001 | Speich | 139/448 |
| 6,453,952 | B1 * | 9/2002 | Verclyte | 139/448 |
| 6,845,792 | B2 * | 1/2005 | Scari et al. | 139/448 |
| 7,128,098 | B2 * | 10/2006 | Verclyte | 139/448 |
| 7,156,337 | B2 * | 1/2007 | Halvarsson et al. | 242/364.8 |
| 2003/0183297 | A1 * | 10/2003 | Scari et al. | 139/448 |
| 2005/0284533 | A1 * | 12/2005 | Verclyte | 139/448 |
| 2007/0289656 | A1 * | 12/2007 | Klaui et al. | 139/448 |

FOREIGN PATENT DOCUMENTS

| | | | |
|---|---|---|---|
| EP | 0 990 723 | A1 | 4/2000 |
| EP | 1 020 550 | A1 | 7/2000 |
| EP | 1 338 688 | A1 | 8/2003 |
| GB | 2 059 455 | A | 4/1981 |

* cited by examiner

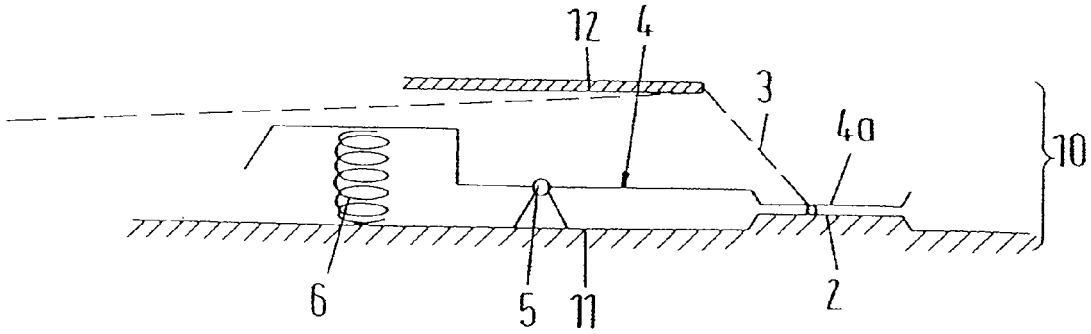
Fig.2 - PRIOR ART -
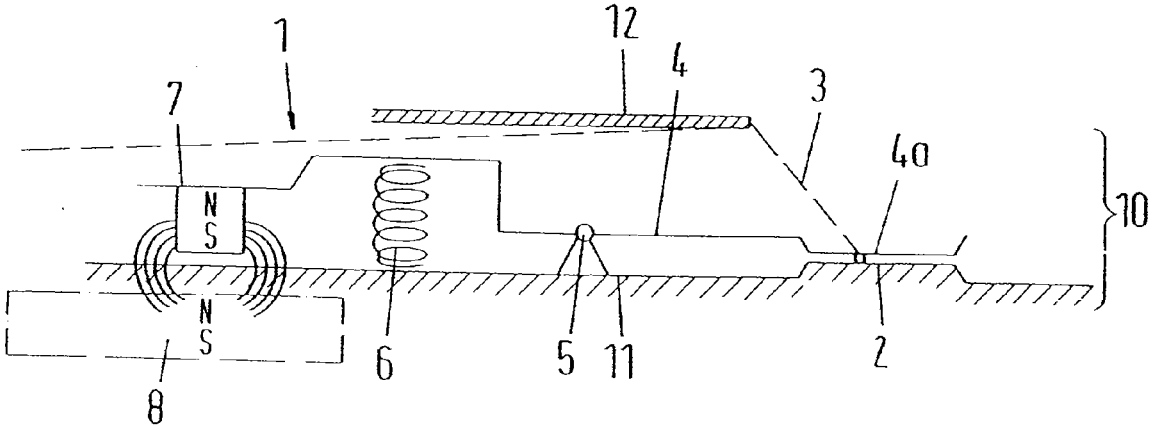
Fig.3

METHOD AND APPARATUS FOR THE INSERTION OF A WEFT THREAD

CROSS-REFERENCES TO RELATED APPLICATIONS

This application claims the priority of European Application No. 06123401.9 filed on Nov. 2, 2006 and European Application No. 07112777.3, filed on Jul. 19, 2007, the disclosures of which are incorporated herein by reference.

BACKGROUND OF THE INVENTION

The invention relates to a method and to an apparatus for the insertion of a weft thread into a shed of a rapier weaving machine as well as to a rapier weaving machine having such an apparatus or equipped to carry out such a method.

In rapier weaving machines the weft thread is inserted into a shed by means of a bringer rapier secured to a rapier rod or to a flexible band and is taken over at a transfer position in the central part of the shed by a taker rapier and transported further. The bringer rapier has the task of reliably taking up the weft thread that is presented, of inserting it into the shed and of leading it precisely to the taker rapier. Each of the rapiers has a rapier head with a thread clamp in order to fixedly clamp the weft thread during the weft insertion. With automatically clamping thread clamps the thread take-up takes place by pulling the weft thread into or out off preset clamping zones of the respective thread clamps.

When coarse and fine weft yarns are inserted one after the other it can happen that the coarse weft yarns, which require a greater clamping force, are fixedly clamped during the take-up at the inlet of the thread clamp where the clamping force is low so that the coarse weft yarns are only weakly held, whereas the fine weft yarns, which require a smaller clamping force, are drawn further into the thread clamp where they are correspondingly strongly held. In both cases operational disturbances can arise in that the coarse weft yarns are too weakly held during the weft insertion while the fine weft yarns are held too strongly during the transfer to the taker rapier and can tear.

For the manufacture of fabrics having weft yarns of different thicknesses or of different smoothness, controlled thread clamps can be used in one or in both rapier heads, with the thread clamp of the bringer rapier being actively opened during the thread take-up and that of the taker rapier being actively closed during the thread take-up.

An electromagnetically controlled thread clamp having an electromagnet as an actuator is for example described in the publication EP 0 690 160 A1. The thread clamp described in EP 0 690 160 A1 for the bringer rapier includes a movable clamping part which is held closed by means of a pre-stressed spring. For the opening of the clamping part a magnetizable part of the clamping part is drawn downwardly by the electromagnet which is arranged beneath the lower shed so that the take-up or transfer of the weft thread takes place with an open thread clamp. The disadvantages of this arrangement are that the construction of the arrangement and the control of the electromagnet are comparatively complicated and that the electromagnet requires a relatively high current which can lead to undesired heating up of the latter.

A further solution lies in the use of a cutting apparatus with a controlled thread clamp device, such as is for example disclosed in FIGS. 6 to 8 of EP 1020550 A1. The thread clamping device disclosed there includes a linear motor which permits the point in time of the release of the thread clamping device, and thus the point in time for the cutting of the weft thread, to be precisely controlled. For fine weft yarns the cutting time point can be advanced so that these are fixedly clamped at the inlet of the thread clamp whereas, for coarser weft yarns, the cutting time point can be delayed so that these are drawn further into the thread clamp.

Since the linear motor of the thread clamping device has to react at an insertion rate of 600 wefts/minute and above within less than 1 ms, comparatively strong and correspondingly expensive linear motors are required which moreover tend to overheat in operation.

SUMMARY OF THE INVENTION

An object of the present invention is to make available a method and an apparatus for the insertion of a weft thread into a shed of a rapier weaving machine, as well as a rapier weaving machine equipped with such an apparatus, or equipped to carry out a method of this kind, which are more simply constructed and/or more simply controllable in comparison to the above-described prior art.

This object is satisfied in accordance with the invention by the methods and apparatus, described herein, as well as by the rapier weaving machine described herein.

In the method in accordance with the invention for the insertion of a weft thread into a shed of a rapier weaving machine, the weft thread is taken up by a bringer rapier, is fixedly clamped in the same by means of a thread clamp, is inserted by means of the bringer rapier into the shed and is taken up by a taker rapier. The method is characterized in that the clamping force of the thread clamp in the bringer rapier is controlled during the weft insertion and in that the clamping force is reduced by means of at least one magnet during the take-up of the weft thread and/or during the transfer of the weft thread relative to the clamping force in the insertion phase lying therebetween.

In an advantageous variant the clamping force is respectively reduced during the take-up of the weft thread and/or during the transfer of the weft thread to a predetermined value, which can be adjustable if required, for example in that the spacing is reduced between the at least one magnet and a magnetizable part cooperating with it. The clamping force is reduced during the take-up of the weft thread, and/or during the take-over of the weft thread, typically by at least 10% and a maximum of 98% or by at least 15% and a maximum of 95%.

In a further variant the clamping force is reduced during the take-up of the weft thread and/or during the transfer of the weft thread without opening the thread clamp. In an analogous manner it is possible, when required, to control the clamping force of the thread clamp in the taker rapier and to increase or to reduce the clamping force of the thread clamp in the taker rapier during the transfer of the weft thread relative to the subsequent insertion phase.

In an advantageous embodiment of the method the point in time at which the clamping force of the thread clamp is reduced and/or the reduction of the clamping forces cancelled again is set in that the at least one magnet, or a magnetizable part cooperating with it, is arranged stationary in the region of the weft thread take-up and/or weft thread transfer and is displaced in the direction of movement of the bringer rapier. Alternatively, or in addition, a magnet, or a magnetizable part cooperating with it, can be arranged at a part of the thread clamp which influences the clamping force and can be displaced relative to the same in the direction of movement of the bringer rapier in order to set the point in time.

The apparatus in accordance with the invention for the insertion of a weft thread into a shed of a rapier weaving machine includes a thread clamp for a bringer rapier and additionally at least one magnet in order to reduce the clamping force of the thread clamp during the take-up of the weft thread and/or during transfer of the weft thread to a taker rapier relative to the clamping force in the insertion phase lying therebetween, advantageously to reduce it to a preset value and/or advantageously without opening the thread clamp during the take-up of the weft thread and/or during the transfer of the weft thread. The magnet or the magnets can for example be so designed and/or arranged and/or controlled that the thread clamp is not opened during the take-up of the weft thread and/or during the transfer of the weft thread. Independently of this, the apparatus can be equipped with a bringer rapier and/or a taker rapier.

When required, it is also possible to provide the thread clamp for the taker rapier with at least one magnet in order to reduce the clamping force of the thread clamp of the taker rapier during the transfer of the weft thread relative to the clamping force in the subsequent insertion phase.

In an advantageous variant the magnet or the magnets are in operative connection with the thread clamp, for example in that one of the magnets is arranged on a part of the thread clamp which influences the clamping force and/or in that one of the magnets can be mounted outside of the rapier, stationary in the region of thread take-up or thread transfer, for example in such a way that the desired reduction of the clamping force can be adjusted via the spacing of the magnet from the rapier.

In an advantageous embodiment at least one of the magnets is formed as a permanent magnet. For example, a permanent magnet can be mounted on a part of the thread clamp which influences the clamping force and/or a permanent magnet can be arranged outside of the rapier, for example on or in the guide of the rapier band and/or of the rapier head.

In a further advantageous embodiment, the spacing between the at least one magnet and a magnetizable part cooperating with it can be changed in order to respectively set the clamping force of the thread clamp during the take-up of the thread and/or during the transfer of the weft thread to a preset value.

In a further advantageous embodiment the at least one magnet and a magnetizable part cooperating with it can be mounted stationary in the region of the weft thread take-up and/or of the weft thread transfer and shifted in the direction of movement of the bringer rapier, or the at least one magnet, or a magnetizable part cooperating with it, is arranged at a part of the thread clamp which influences the clamping force and is displaceable with respect to the same in the direction of movement of the bringer rapier in order to set the point in time at which the clamping force of the clamping thread is reduced and/or the reduction of the clamping force is cancelled again.

Furthermore, the invention includes a rapier weaving machine having an apparatus in accordance with one of the above-described variants or embodiments and/or equipped to carry out a method in accordance with the above description.

The apparatus and the method in accordance with the present invention as well as the rapier weaving machine in accordance with the invention have the advantage relative to controlled thread clamps from the prior art that they are very rapid, because the thread clamp does not have to be opened to take-up the weft thread and/or to transfer the weft thread but rather only the clamping force has to be reduced and the control of the clamping force takes place practically without relative movement of the thread clamping parts by magnetic force. Moreover, the above-described apparatus is comparatively simple and can be manufactured at favorable cost as well as being suitable for retrofitting to existing rapier weaving machines. A further advantage lies in the contact-free control of the clamping force by magnetic force which is also effective through the sheet metal parts normally used in the rapiers as well as in the insensitivity to contamination of the described apparatus and of the described method. Moreover, the described apparatus contains no elements which project from the outside into the shed. The reduction in the clamping force can be set in simple manner in that the spacing between the magnet and a magnetizable part of the apparatus cooperating therewith, for example a second magnet, is varied. If permanent magnets are used in the described apparatus and in the described method, then the entire cost and complexity, which is necessary in customary controlled thread clamps for the actuation of electrical actuators, for power supply, control and cabling, can be dispensed with.

The above description of the embodiments simply serves as an example. Further advantageous embodiments can be seen from the dependent claims and from the drawing. Moreover, individual features from the described or shown embodiments or variants can be combined with one another in the context of the present invention to form new embodiments.

In the following, the invention will be described in more detail with reference to an embodiment and to the drawing.

BRIEF DESCRIPTION OF THE DRAWINGS

FIG. 2 is a schematic representation of a thread clamp in a customary bringer rapier in section, FIG. 3 is a schematic representation of an embodiment of an apparatus in accordance with the present invention in section.

DESCRIPTION OF THE PREFERRED EMBODIMENTS

Figures 1A, 1B:
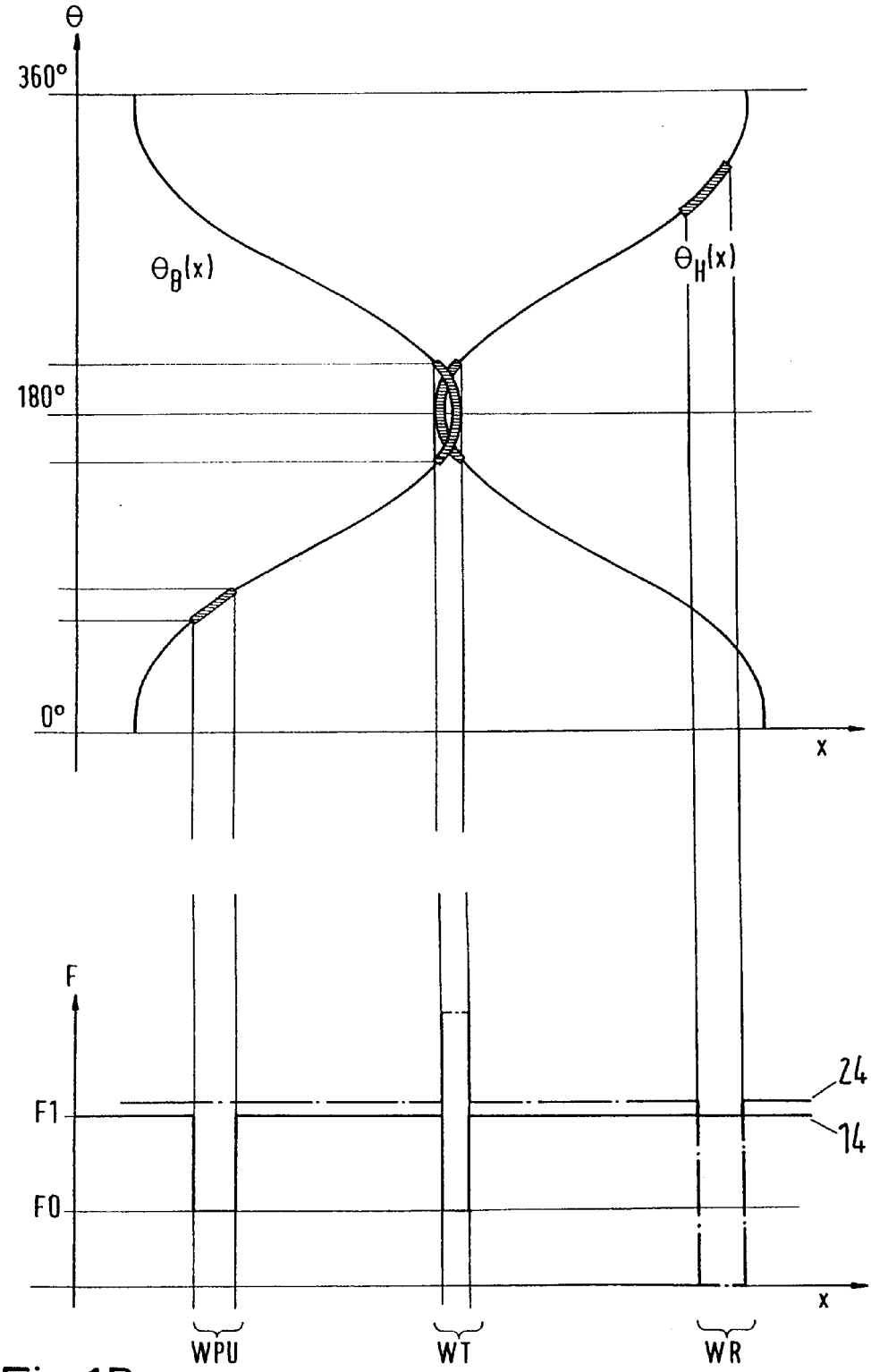
FIG. 1A is a path diagram for the motion of a bringer rapier and of a taker rapier in a rapier weaving machine during the weft insertion.
FIG. 1B is a diagram of the clamping force of a rapier thread clamp during the weft insertion in an embodiment in accordance with the present invention.

FIG. 1A shows a path diagram in which the movement of a bringer rapier and of a taker rapier in a rapier weaving machine is illustrated during the weft insertion. In the illustrated path diagram the insertion direction and the distance x traveled in this direction is drawn in as the abscissa and perpendicular to this the angle of rotation θ as ordinate. As shown in the diagram, the bringer rapier and the taker rapier are periodically moved to and fro in the insertion direction for weft insertion.

The path diagram $\theta_B(x)$ of the bringer rapier starts in the illustrated embodiment at θ=0° at the first reversal point of the motion of the bringer rapier which is disposed before the shed in the weft insertion direction. The bringer rapier is subsequently accelerated and takes up the weft thread in a path section WPU in order to insert it into the shed. Towards the center of the web the bringer rapier with the weft thread is slowed down and in a path section WT a taker rapier takes up the weft thread in the second reversal point of the bringer rapier movement at θ=180°, whereupon the bringer rapier returns to the first reversal point, i.e. the starting point at θ=360°. The path diagram $\theta_H(x)$ of the taker rapier starts in the illustrated embodiment at θ=0° at the first reversal point of the taker rapier motion which is arranged after the shed in the weft insertion direction. The taker rapier is subsequently accelerated and slowed down towards the center of the shed in order to take over the weft thread from the bringer rapier as described above in the part section WT at the second reversal point of the motion of the taker rapier at θ=180°. Thereafter, the taker rapier together with the weft thread is accelerated anew in order to continue the weft insertion and, after the conclusion of the weft insertion, is slowed down again towards the first point of reversal at θ=360°.

FIG. 1B shows a diagram of the clamping force 14 of a thread clamp of a bringer rapier and also a diagram of the clamping force 24 of a thread clamp of a taker rapier in an embodiment in accordance with the present invention. In the diagram shown in FIG. 1B the insertion direction and the path x traveled in this direction are drawn in as abscissa and perpendicular to it the clamping force F as ordinate. FIG. 1B is arranged directly below FIG. 1A and the same scaling is used for the abscissa as in FIG. 1A so that corresponding path points in FIGS. 1A and 1B lie vertically above one another.

An embodiment of the method of the invention for the insertion of the weft thread into a shed of a rapier weaving machine will be described in the following with reference to FIGS. 1A and 1B. In the embodiment the weft thread is taken up by a bringer rapier, for example during a path section WPU; is fixedly clamped in the latter by means of a thread clamp; is inserted by means of the bringer rapier into the shed; and is taken up by a taker rapier, for example as shown in FIG. 1A in a path section WT, which can for example lie in the region of the turning points of the motion of the bringer and taker rapiers. The method is characterized in that the clamping force of the thread clamp in the bringer rapier is controlled during the weft insertion and in that the clamping force is reduced by means of at least one magnet during the take-up of the weft thread and/or during transfer of the weft thread relative to the clamping force in the insertion phase lying therebetween, for example in accordance with the plot of the clamping force 14 shown in FIG. 1B, which is drawn in in the diagram as a continuous line.

If required, it is also possible to control the clamping force of the thread clamp in the taker rapier in that the clamping force of the thread clamp in the taker rapier is increased or reduced relative to the following insertion phase by means of at least one magnet during the transfer of the weft thread, for example in accordance with the plot of the clamping force 24 shown in FIG. 1B which is drawn in in the diagram as a chain-dotted line. The thread clamp of the taker rapier is expediently opened after conclusion of the weft insertion in order to release the inserted weft thread, for example in a path section WR shown in FIG. 1B.

In an advantageous variant, the clamping force is reduced during the take-up of the weft thread and/or during the transfer of the weft thread without opening the thread clamp. In a further advantageous variant, the clamping force is respectively reduced during the take-up of the weft thread and/or during the transfer of the weft thread to a predetermined value F0, which can be adjustable if required, for example in that the spacing is changed between the at least one magnet and a magnetizable part cooperating with it. In some cases it is also possible to provide different values for the reduction of the clamping force for the take-up of the weft thread and for the transfer of the weft thread. The clamping force can for example be reduced by at least 10% and by a maximum of 98% or by at least 15% and by a maximum of 95%. In analogous manner it is also possible, when required, to control the clamping force of the thread clamp in the taker rapier and to increase or to reduce the clamping force of the thread clamp in taker rapier during transfer of the weft thread relative to the subsequent insertion phase, for example with two oppositely poled magnets being able to be used in order to increase the clamping force.

In an advantageous embodiment of the method, the point in time at which the clamping force of the thread clamp is reduced and/or the reduction of the clamping force is cancelled again is set in that the at least one magnet, or a magnetizable part cooperating with it, is arranged stationary in the region of the weft thread take-up and/or weft thread transfer and is displaced in the direction of movement of the bringer rapier. Alternatively, or in addition, a magnet, or a magnetizable part cooperating with it, can be arranged for the adjustment of the time point on a part of the thread clamp which influences the clamping force and can be displaced with respect to the same in the direction of movement of the bringer rapier.

Due to the reduction of the clamping force during the take-up of the weft thread and/or during the transfer of the weft thread, a higher value can be provided for the clamping force F1 in the insertion phase lying therebetween than is possible without control of the clamping force. With the above-described method the reliability of the weft insertion can thus be increased.

FIG. 2 shows a schematic representation of a thread clamp in a customary bringer rapier in section. The bringer rapier 10 shown includes a lower part 11 which can for example be formed of sheet metal, an upper part 12 which can likewise be formed of sheet metal and a thread clamp. The thread clamp includes a support 2 which can for example be formed at the base part and a two-armed lever 4 which is pivotably journalled between the lever arms about an axis of rotation 5. A pre-stressed spring 6 is provided at one of the lever arms and acts on the same and a clamping part 4*a* is provided on the other lever arm which is pressed by the force of the spring 6 onto the support 2 in order to clamp a weft thread 3 firmly between the rest 2 and the clamping part 4*a*. In the above-described thread clamp this is simply a typical embodiment. Many further embodiments are known from the prior art. Thus the movable part of the thread clamp can for example be designed as a one-armed lever as shown in FIG. 2 of EP 0 690 160 A1 which is for example pivotable at one end by means of an axis of rotation or is resiliently mounted by means of a leaf spring or the movable part of the thread clamp can for example be made resilient as a whole.

An embodiment of an apparatus for the insertion of a weft thread into a shed of a rapier weaving machine in accordance with the present invention will be explained in the following with reference to FIG. 3. In the embodiment shown the apparatus 1 includes a thread clamp for a bringer rapier 10 and in addition at least one magnet 7, 8 in order to reduce the clamping force of the thread clamp during the take-up of the weft thread and/or during the transfer of the weft thread to a taker rapier relative to the clamping force in insertion phase lying therebetween.

The thread clamp can for example, as already explained above in connection with the description of FIG. 2, include a support 2 and a two-armed lever 4 which is pivotably journalled about an axis of rotation 5. A pre-stressed spring 6 can be provided at one of the lever arms to generate a clamping force and a clamping part 4*a* can be provided on the other lever arm which is pressed by the force of the spring 6 onto the support 2 in order to clamp a weft thread 3 between the support 2 and the clamping part 4*a*. The above-described weft clamp is, as already mentioned in FIG. 2, simply a typical embodiment. The lever can for example also be a one-arm lever and can for example be pivotably mounted at one end by means of an axis of rotation or resiliently mounted by means of a leaf spring or the movable part of the clamp is made resilient, either in part or as a whole. If required, the clamping force of the thread clamp can be made adjustable in that, for example, the pre-stress of the spring is varied.

In an advantageous embodiment the magnet or magnets 7, 8 is or are so designed and/or arranged and/or controlled that the thread clamp is not opened during the take-up of the weft thread and/or during the transfer of the weft thread. In a further advantageous embodiment the clamping force of the thread clamp is reduced during the take-up of the weft thread and/or during the transfer of the weft thread to a predetermined value which can be adjustable if required. A corresponding setting device will be explained in the following in more detail in the context of the description of the second embodiment.

In an advantageous embodiment the magnet or the magnets 7, 8 is or are in operative connection with the thread clamp, for example in that a first magnetizable part 7, such as for example an iron part or a magnet, is arranged on a part 4 of the thread clamp which influences the clamping force and a second magnetizable part 8 can be mounted outside of the rapier stationary in the region of the weft thread take-up and/or of the weft thread transfer, with the two magnetizable parts belonging, for example, to a magnetic circuit which contains at least one magnet. If required, the desired reduction of the clamping force can for example be set via the spacing of the two magnetizable parts.

In a further advantageous embodiment the at least one magnet 7, 8 is formed as a permanent magnet. For example a permanent magnet 7 can be arranged on a part of the thread clamp, for example on a lever 4, which influences the clamping force and/or a permanent magnet 8 can be mounted outside of the rapier, for example on or in the guide of the rapier band or of the rapier head.

Figure 4:
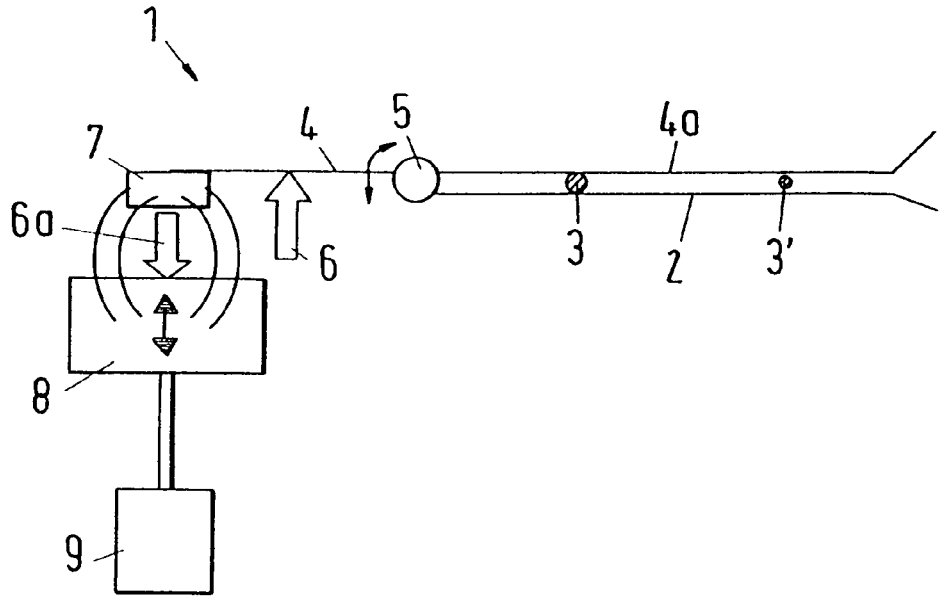
FIG. 4 is a schematic representation of a second embodiment of an apparatus in accordance with the present invention in section.

FIG. 4 shows a schematic representation of a second embodiment of an apparatus 1 in accordance with the present invention in section. In the embodiment shown, the apparatus 1 includes a thread clamp for a bringer rapier and additionally at least one magnet 7, 8 in order to reduce the clamping force of the thread clamp during the take-up of the weft thread and/or during the transfer of the weft thread to a taker rapier relative to the clamping force in the insertion phase lying therebetween.

The thread clamp can, for example, as already explained above in the context of the description of FIGS. 2 and 3, include a support 2 and a two-armed lever 4 which is pivotally mounted about an axis of rotation 5. A force 6 which is generated by a resetting element arranged in the rapier, for example a spring, acts on one of the lever arms in order to press a clamping part 4*a* provided at the other lever arm onto the support 2 and to fixedly clamp a weft thread 3, 3' between the support 2 and the clamping part 4*a*. As far as the above-described thread clamp is concerned, this is, as already mentioned in connection with FIG. 3, simply a typical embodiment. Further embodiments of the thread clamp are explained in the context of the description of FIG. 3.

In a preferred embodiment the magnet or the magnets are in operative connection with the thread clamp, for example in that a first magnetizable part 7, such as for example an iron part or a magnet, is arranged on a part 4 of the thread clamp which influences the clamping force and in that a second magnetizable part 8 can be mounted stationary outside of the rapier in the region of the weft thread take-up and or weft thread transfer, wherein, in operation, when the rapier is located in the region of the weft thread take-up and/or weft thread transfer, the two magnetizable parts 7, 8 cooperate and, for example, form a magnetic circuit which contains at least one magnet. The first magnetizable part 7 can, for example as shown in FIG. 4, be arranged on a lever arm of the two-armed lever 4 while the clamping part 4*a* is provided at the other lever arm. It is, however, for example also possible to provide a magnetizable sheet metal spring as support 2 for the thread clamp which is for example mounted at one end and can simultaneously be used as a support and as a first magnetizable part 7. In this case, the clamping force of the sheet metal spring serving as the support can be reduced by means of a second magnetizable part 8, which is formed as a magnet.

In the second embodiment the spacing between the at least one magnet 7, 8 and a magnetizable part 7, 8 cooperating with it can be changed in order to respectively set the clamping force of the thread clamp during the take-up of the weft thread and/or during the transfer of the weft thread to a preset value. For this purpose a setting device 9 is provided in the apparatus 1 by means of which the distance between the at least one magnet and the magnetizable part cooperating with it can be changed. The setting device 9 can be executed manually or with a positioning drive, for example a positioning drive with a linear motor. The required setting range typically extends over 5 mm or 1 or 2 cm. A possible setting drive can be designed to be comparatively small and slow since sufficient time is available for the setting from one weft insertion to the next and the setting forces that are required are low.

In a further advantageous embodiment the at least one magnet is formed as a permanent magnet. For example, a permanent magnet 7 can be arranged on a part of the thread clamp which influences the clamping force, for example on a lever 4, and/or a permanent magnet 8 can be mounted stationary outside of the rapier in the region of the weft thread take-up and/or of the weft thread transfer, for example on or in the guide of the rapier band or of the rapier head.

Due to the above-described setting of the reduction in clamping force during the take-up of the weft thread, weft threads of different thickness or different smoothness can be ideally held in the thread clamp. Without this setting the tendency exists that a thick weft thread will be fixedly clamped during the take-up at the inlet of the thread clamp where it is only weakly held because of the comparatively long lever arm, whereas a thinner weft thread will be drawn up to and into the vicinity of the rotation point of the lever where it is correspondingly strongly held. In both cases operational disturbances can arise in that the thick weft thread is not held sufficiently firmly during the weft insertion whereas the thin weft thread is too strongly held during the transfer to the taker rapier and can tear. By means of the described setting of the reduction of the clamping force a situation can be achieved in which the thick weft thread 3 is fixedly clamped further inside the thread clamp, as shown in FIG. 4, where the clamping force is larger, whereas the thinner weft thread 3' is fixedly clamped at the inlet of the thread clamp where the clamping force is weaker. If a setting drive is provided for the setting of the clamping force reduction, the clamping force reductions can be matched between the weft insertions, for example to thick or thin weft threads. In this manner, weft threads of different thickness and different smoothness can be inserted one after the other with an ideal clamping force.

Figure 5:
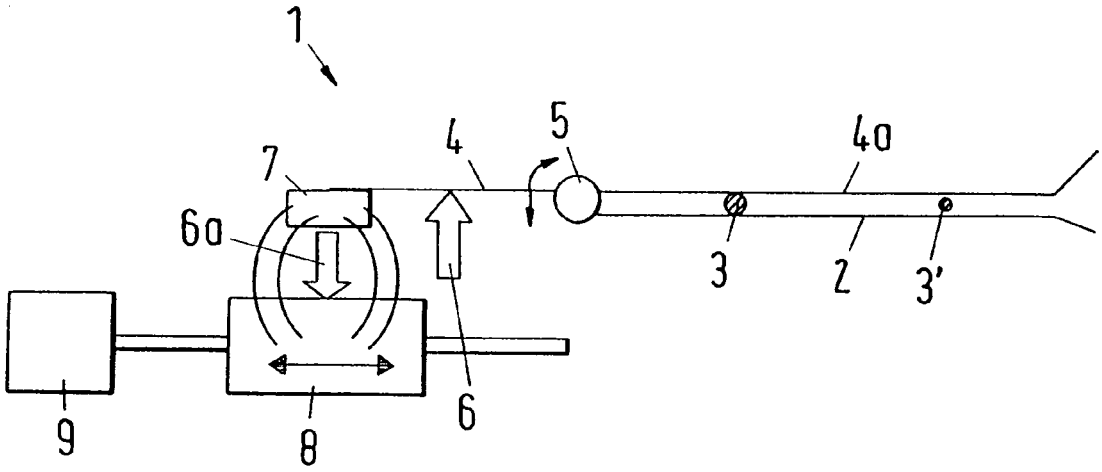
FIG. 5 is a schematic illustration of a third embodiment of an apparatus in accordance with the present invention in section.

FIG. 5 shows a schematic representation of a third embodiment of an apparatus 1 in accordance with the present invention in section. The apparatus 1 shown in FIG. 5 includes a thread clamp for a bringer rapier and additionally at least one magnet 7, 8 in order to reduce the clamping force of the thread clamp during the take-up of the weft thread and/or during the transfer of the weft thread to a taker rapier relative to the clamping force in the insertion phase lying therebetween. Possible embodiments of the thread clamp have already been explained in the context of the above description of the second embodiment.

In a preferred embodiment, the magnet or the magnets are in operative connection with the thread clamp, for example in that a first magnetizable part 7, such as for example an iron part or a magnet, is arranged on a part 4 of the thread clamp which influences the clamping force and in that a second magnetizable part 8 can be mounted stationary outside of the rapier in the region of the weft thread take-up and/or of the weft thread transfer, wherein, in operation, when the rapier is located in the region of the weft thread take-up and/or of the weft thread transfer, the two magnetizable parts cooperate and in this respect for example form a magnetic circuit which contains at least one magnet 7, 8.

In the third embodiment the at least one magnet 8 or a magnetizable part 8 which cooperates with it can be mounted stationary in the region of the weft thread take-up and/or of the weft thread transfer and, as indicated in FIG. 5 with a double arrow, can be displaced in the direction of movement of the bringer rapier in order to set the point in time at which the clamping force of the thread clamp is reduced and/or the reduction of the clamping force is cancelled again. Alternatively, or additionally, the at least one magnet 7, or a magnetizable part 7 cooperating with it, can be arranged on a part 4 of the thread clamp which influences the clamping force and can be displaced with respect to same in the direction of movement of the bringer rapier in order to set the point in time. For the setting of the point in time, a setting device 9 can be provided in the apparatus 1 by means of which the at least one magnet 8, or a magnetizable part 8 cooperating with it, can be displaced in the direction of movement of the bringer rapier. The setting device 9 can be designed manually or with a positioning drive, for example with a positioning drive with a linear motor. The required displacements of the at least one magnet, or of the magnetizable part cooperating with it, typically amount to 5 mm or 1 or 2 cm. A possible positioning drive can be designed to be comparatively small and slow since sufficient time is present from one weft insertion to the next and the required positioning forces are low.

In a further advantageous embodiment the at least one magnet can be formed as a permanent magnet. For example a permanent magnet 7 can be arranged on a part of the thread clamp which influences the clamping force, for example on the lever 4, and/or a permanent magnet 8 can be mounted stationary outside of the rapier in the region of the weft thread take-up and/or of the weft thread transfer, for example at or in the guide of the rapier band or of the rapier head.

Due to the above-described setting of the point in time at which the clamping force of the thread clamp is reduced and/or the reduction of the clamping force is cancelled again, weft threads of different thickness or different smoothness can be ideally held in the thread clamp. By means of the described setting of the point in time for the cancelling of the reduction in the clamping force, a situation can be achieved in which a thick weft thread 3 is fixedly clamped closer to the point of rotation 5 of the lever, as shown in FIG. 4, where the clamping force is larger, whereas the thin weft thread 3' is fixedly clamped at the inlet of the thread clamp where the clamping force is weaker. If a positioning drive is provided for the setting of the reduction of the clamping force, the clamping force reduction can be selectively matched during the weft insertions to thick and thin weft threads and also to weft threads of different smoothness. In this manner weft threads of different thickness and different smoothness can be inserted one after the other with ideal clamping force.

Moreover, the cutting device can be simplified in that all weft threads can now be cut at the same point in time because they already have the desired position in the thread clamp as a result of the above-described setting of the point in time at which the clamping force of the thread clamp is reduced and/or the reduction of the clamping force is cancelled again.

Independently of the above features of the embodiment, the above-described setting of the operative point in time by displacement of a magnetizable part in the direction of movement of the rapier is suitable for all kinds of magnetically controlled thread clamps, for example also for thread clamps which are fully opened. In a particularly advantageous embodiment one or more permanent magnets are used for the control and/or actuation of the thread clamp.

Figure 6:
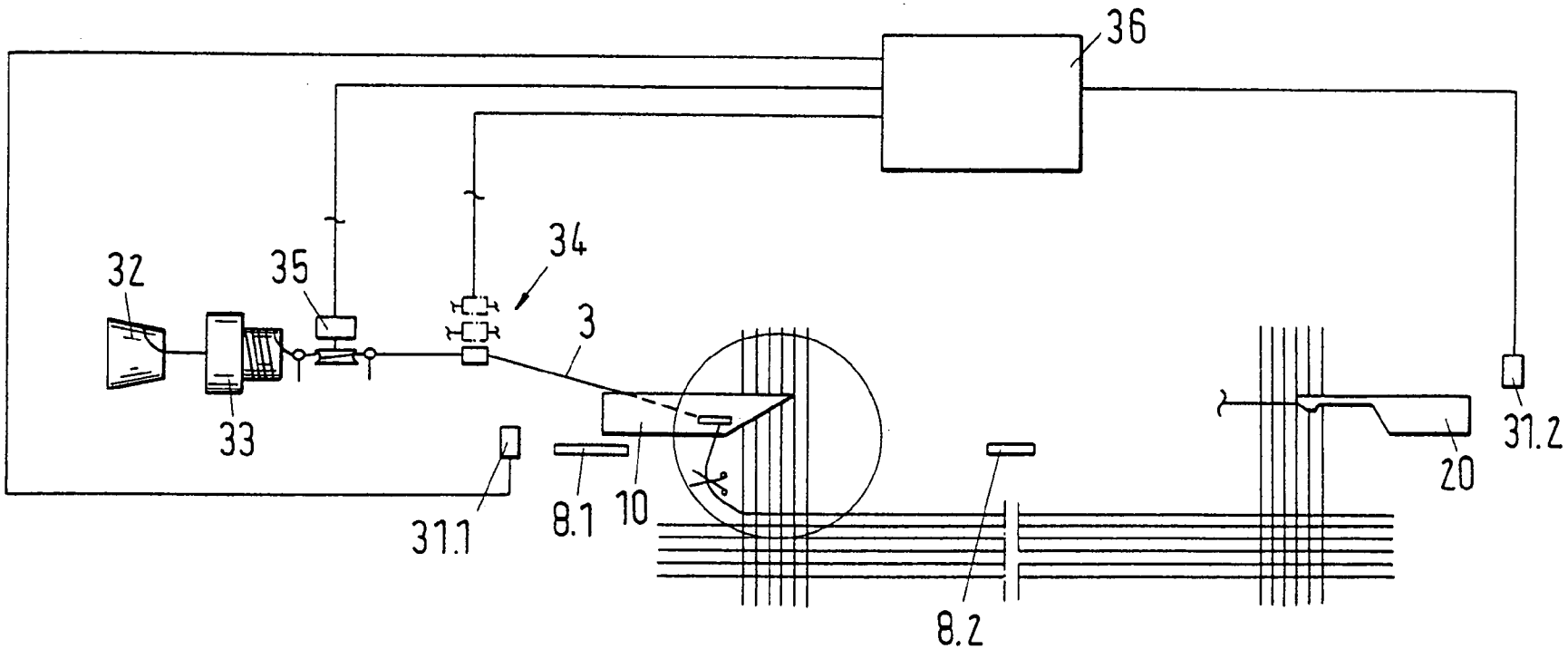
FIG. 6 is a schematic representation of a rapier weaving machine having an apparatus in accordance with the present invention.

FIG. 6 shows an embodiment of a rapier weaving machine having an apparatus in accordance with one of the above-described embodiments and/or equipped to carry out a method in accordance with the above description. Of the apparatus, in the embodiment shown in FIG. 6, a bringer rapier 10 and, in the region of the weft thread take-up and of the weft thread transfer, a respective magnetizable part 8.1, 8.2 are visible, with the magnetizable part for example being able to be designed as an iron part or as a magnet. Depending on the case, the apparatus can include a taker rapier 20 and also a thread supply 32, a thread store 33, a thread presenter 34 or a thread brake 35 for a weft thread 3 and, if required, a control 36 and one or more sensors 31.1, 31.2.

The apparatus, the method and the rapier weaving machine in accordance with the above description combine the advantages of an actively controlled thread clamp with a simple and economic design.

The invention claimed is:

1. A method for the insertion of a weft thread into a shed of a rapier weaving machine in which the weft thread is taken up by a bringer rapier and fixedly clamped in the same by means of a thread clamp;

is inserted by means of the bringer rapier into the shed;

is taken over by a taker rapier and fixedly clamped in the same by means of a thread clamp; and the insertion of the weft thread is continued by means of the taker rapier, wherein the clamping force of the thread clamp in the bringer rapier is controlled during the weft insertion in that the clamping force of the thread clamp is reduced by means of at least one magnet and a magnetizable part cooperating with the at least one magnet during the take-up of the weft thread and/or during the take-over of the weft thread relative to the clamping force in the insertion phase lying therebetween, and one of the at least one magnet and the magnetizable part is arranged on a part of the thread clamp and the other is mounted outside of the rapier and is stationary with respect to the rapier.

2. A method in accordance with claim 1, wherein the clamping force of the thread clamp in the bringer rapier is reduced during the take-up of the weft thread and/or during the take-over of the weft thread without opening the thread clamp.

3. A method in accordance with claim 1, wherein the clamping force of the thread clamp in the bringer rapier is reduced during the take-up of the weft thread and/or during the take-over of the weft thread by at least 10% and by at most 98%, in particular by at least 15% and at most 95%.

4. A method in accordance with claim 1, wherein the clamping force of the thread clamp in the bringer rapier is respectively set during the take-up of the weft thread and/or during the take-over of the weft thread to a predetermined value in that the spacing between the at least one magnet and the magnetizable part cooperating with it is changed.

5. A method in accordance with claim 1, wherein the point in time at which the clamping force of the thread clamp is reduced and/or the reduction of the clamping force is cancelled again is set in that the at least one magnet, or a magnetizable part cooperating with it, is arranged stationary in the region of the weft thread take-up and/or of the weft thread take-over and is displaced in the direction of movement of the bringer rapier, or in that the at least one magnet or the magnetizable part cooperating with it is arranged on a part of the thread clamp which influences the clamping force and is displaced with respect to the same in the direction of movement of the bringer rapier.

6. An apparatus for the insertion of a weft thread into a shed of a rapier weaving machine, said apparatus including a thread clamp for a bringer rapier, wherein the apparatus additionally includes at least one magnet and a magnetizable part cooperating with the at least one magnet in order to reduce the clamping force of the thread clamp during the take-up of the weft thread and/or during the take-over of the weft thread to a taker rapier relative to the clamping force in the insertion phase lying therebetween, to a predetermined value and wherein one of the at least one magnet and of the magnetizable part is arranged on a part of the thread clamp and the other is mounted outside of the rapier and is stationary with respect to the rapier.

7. An apparatus in accordance with claim 6, wherein the magnet or the magnets is or are so designed and/or arranged and/or controlled that the thread clamp is not opened during the take-up of the weft thread and/or during the take-over of the weft-thread.

8. An apparatus in accordance with claim 6, wherein the magnet or the magnets stands or stand in operative connection with the thread clamp, in particular in that one of the magnets is arranged on a part of the thread clamp which influences the clamping force.

9. An apparatus in accordance with claim 6, wherein at least one of the magnets is formed as a permanent magnet.

10. An apparatus in accordance with claim 6 including a permanent magnet which is arranged on a part of the thread clamp which influences the clamping force and a permanent magnet which can be mounted on or in the guide of the rapier band and/or of the rapier head.

11. An apparatus in accordance with claim 6, wherein the spacing between the at least one magnet and the magnetizable part cooperating with it can be changed in order to respectively set the clamping force of the thread clamp to a predetermined value during the take-up of the weft thread and/or during the take-over of the weft thread.

12. An apparatus in accordance with claim 6, wherein the at least one magnet or the magnetizable part cooperating with it can be displaced in the direction of movement of the bringer rapier, or wherein the at least one magnet, or the magnetizable part cooperating with it, is arranged on a part of the thread clamp influencing the clamping force and is displaceable relative to the same in the direction of movement of the bringer rapier in order to set the point in time at which the clamping force of the thread clamp is reduced and/or the reduction of the clamping force is cancelled again.

13. An apparatus in accordance with claim 6 additionally comprising a bringer rapier.

14. An apparatus in accordance with claim 6 additionally comprising a rapier weaving machine.

15. A rapier weaving machine equipped for the insertion of a weft thread into a shed of a rapier weaving machine in which the weft thread is taken up by a bringer rapier and fixedly clamped in the same by means of a thread clamp;

is inserted by means of the bringer rapier into the shed;

is taken over by a taker rapier and fixedly clamped in the same by means of a thread clamp; and the insertion of the weft thread is continued by means of the taker rapier, wherein the clamping force of the thread clamp in the bringer rapier is controlled during the weft insertion in that the clamping force of the thread clamp is reduced by means of at least one magnet and of a magnetizable part cooperating with the at least one magnet during the take-up of the weft thread and/or during the take-over of the weft thread relative to the clamping force in the insertion phase lying therebetween, and one of at least one magnet and of the magnetizable part is arranged on a part of the thread clamp and the other one is mounted outside of the rapier and is stationary with respect to the rapier.

16. A method in accordance with claim 1, wherein at least one of the at least one magnet and the magnetizable part provide a counter force to the clamping force of the thread clamp.

17. A apparatus in accordance with claim 6, wherein at least one of the at least one magnet and the magnetizable part provide a counter force to the clamping force of the thread clamp.

18. A rapier weaving machine in accordance with claim 15, wherein at least one of the at least one magnet and the magnetizable part provide a counter force to the clamping force of the thread clamp.

19. An apparatus in accordance with claim 6 wherein the magnet or magnets is or are mounted stationary outside of the rapier in the region of the weft thread take-up and/or of the weft thread take-over.

* * * * *